United States Patent [19]

Powell

[11] Patent Number: 4,989,279

[45] Date of Patent: Feb. 5, 1991

[54] MODULAR BATHING FACILITY

[76] Inventor: Samuel O. Powell, 1115 Oak Hill Ave., Hagerstown, Md. 21740

[21] Appl. No.: 325,433

[22] Filed: Mar. 20, 1989

[51] Int. Cl.[5] ..... A47K 3/22; A47K 3/23

[52] U.S. Cl. ..... 4/612; 4/599; 4/614; 210/406

[58] Field of Search ..... 4/599, 596, 600, 612, 4/614, 608; 210/416.1, 416.2, 406, 169; 417/181, 40, 41, 46

[56] References Cited

U.S. PATENT DOCUMENTS

| | | | |
|---|---|---|---|
| 2,407,190 | 6/1946 | Tait . | |
| 3,963,376 | 6/1976 | Miskin | 417/40 |
| 4,348,777 | 6/1982 | Peterson . | |
| 4,349,434 | 9/1982 | Jaworski | 210/416.2 |
| 4,374,024 | 1/1983 | Peloquin et al. . | |
| 4,376,048 | 3/1983 | Kovacs | 210/416.1 |
| 4,457,031 | 7/1984 | Moore | 4/605 |
| 4,471,501 | 7/1984 | Heymann . | |
| 4,482,299 | 11/1984 | Eulass | 417/40 |
| 4,552,657 | 11/1985 | Ogawa | 210/416.2 |
| 4,675,923 | 2/1987 | Ashley . | |
| 4,828,709 | 5/1989 | Houser et al. | 4/597 |

*Primary Examiner*—Henry J. Recla

*Assistant Examiner*—Keith Kupferschmid

*Attorney, Agent, or Firm*—Eugene F. Osborne

[57] ABSTRACT

A modular facility for on-site erection at work places and recreation areas is provided in kit form of expendable components for temporary periods of bathing, permitting users to transmit through privacy compartments including an entry "dirty" booth, an intermediate shower booth, and an exit "clean" booth. The facility is serviced by a portable shower and waste water filtration subsystem that operates solely on the flow of an input pressurized supply of water. Filter elements are removeable to recover particles and contaminants from the waste water of shower bathing.

3 Claims, 4 Drawing Sheets

MODULAR BATHING FACILITY

BACKGROUND OF THE INVENTION

1. Field of the Invention

This invention in its preferred embodiment relates to privacy booths for personal disrobing, bathing, and dressing under short term or temporary situations where permanent facilities are not available and in certain applications where needs exist for effluent filtration and for the recovery of particles. Applications for portable erectable booths and showers are anticipated where persons make transitions between differing activities or environments for purposes of working or of recreation.

2. Description of the Prior Art

A typical portable transitional shower facility is an assembly of three contiguous compartmental units including a "dirty" entry derobing compartment, the intermediate shower, and an exit "clean" compartment. Frequently the facility is delivered to the site in kit form where it is erected for use. In some applications persons make two way passages through the facility—one direction upon arriving at the site and the reverse direction upon leaving.

In the prior art Ashley, U.S. Pat. No. 4,675,923, teaches base pans, positionable side-by-side, and a tent frame extending upward to support curtains that form the walls and the passageways of the three compartments. An electrically powered pump is used to discharge filtered water from the shower to a suitable drain. For portability the base pans are arranged to form a shipping box for the apparatus for delivery or removal from the work site.

In the patent of Peterson, U.S. Pat. No. 4,348,777, a semi-portable shower is disclosed having a single skid base and three permanently fixed compartments positioned thereon. The Peterson facility requires electricity for ventilation, and heating of air and water. In addition the facility has timing apparatus for regulating the use of each of the compartments and a conveyor for moving clothing from the first to the third compartment for recovery after the person has bathed in the intermediate second compartment. The geometry of the facility is not adaptable in height or in occupied floor space.

SUMMARY OF THE INVENTION

The present invention provides an adaptable low-cost facility for decontamination and bathing applications. It has an entry compartment where the worker disrobes when the decontamination task is complete, an inside compartment for bathing, and an exit compartment where the worker dresses for the return to off work activities. Major portions of the facility are disposable.

In its preferred implementation the invention can be rapidly assembled at the site and put into service with single hose connection to a source of pressurized water and with a hose to a suitable drain. For safety, minimum weight and low cost, the invention does not require electrical power in any phase or cycle of its use. The effluent of the shower is filtered to remove particles or solid contaminants. The filtered water is discharged to the drain by a pump that is operative upon the input pressurized supply of water.

The water resistant disposable components that mesh to form abutting compartments may be adapted to low ceilings and the requirements of the work site, using ordinary hand tool. Curtains seal the entire length of each passageway so as to secure and isolate each compartment to prevent back drafts and escape of contaminants.

An objective of the present invention is to provide a low cost disposable bathing facility that may be erected, modified if necessary, and disassembled at the work site.

Another objective of the invention is to filter and discharge the effluents of bathing without a requirement for an electrical power source.

Another objective of the invention is to provide component parts for the assembly of the facility that can be transported to the work site in a small volume.

Another objective of the invention is to provide disposable components for the assembly of the facility that are easily fit into waste containers or are biodegradable after their use and disposal.

Still another objective of the invention is an integrated pump and filtering subsystem for recovering particles and contaminants before discharging spent liquids from the bath.

A further objective of the invention is the ability to function at a work site with a single demand for on-site support; i.e., a source of pressurized potable water together with a suitable drain conduit.

A further objective of the invention is an effluent ejector pump, operative from the energy of a source of pressurized water (typically at 20–40 psi flowing at a rate of at least four gallons per minute) to lift fluids from the shower bath for filtering and discharge of residual water in nearby drains or natural surface drainage.

An additional objective of the invention is a disposable low-cost facility that has an on-site operating lifetime of at least 5 working days, providing for at least 60 shower baths.

An additional objective is to provide an optional nonbiodegradable material for certain parts of the invention to extend their service life to 10 working days and 120 shower baths.

Many other objectives, features, and advantages of the present invention will be apparent from a reading of the specification which follows in conjunction with the accompanying drawings.

DESCRIPTION OF PREFERRED EMBODIMENTS

Figure 1:
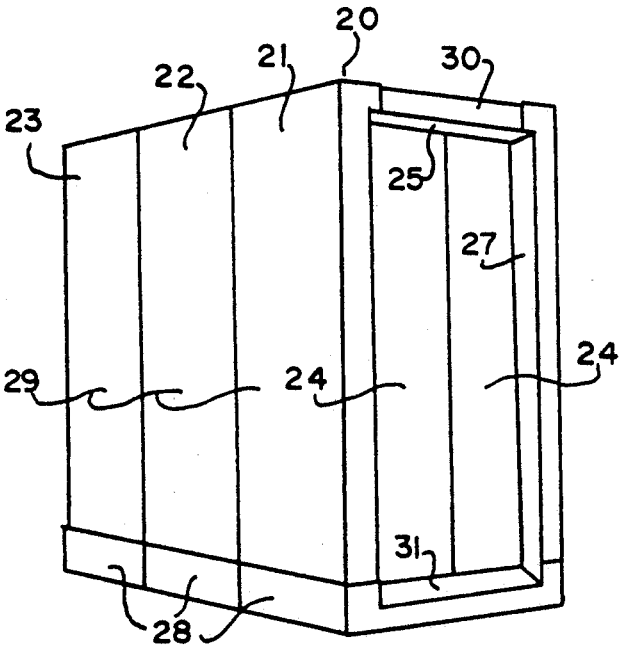
FIG. 1 is a perspective view of an assembled decontamination facility.

Referring initially to FIG. 1, the modular shower bath facility 20 has three similar meshing box compartments standing vertically through which persons pass upon arriving and upon leaving a work or recreation site. There is an off-site "clean" change compartment 21, an interior shower bathing compartment 22, and an on-site "dirty" compartment 23.

As an example, a worker upon arrival at the site will enter the off-site compartment 21 where street apparel are removed and are stored. Here the worker dons his working apparel. The worker will then pass through the shower 22 and through the on-site compartment 23. He then advances to the working site. Upon leaving the work site the worker enters the on-site compartment 23, where the working apparel are removed and may be deposited in a suitable disposal bag. He will then enter the shower compartment 22 to bathe, sanitize, or disinfect and pass into the off-site compartment 21 where he dresses for return to the street.

Figure 2:
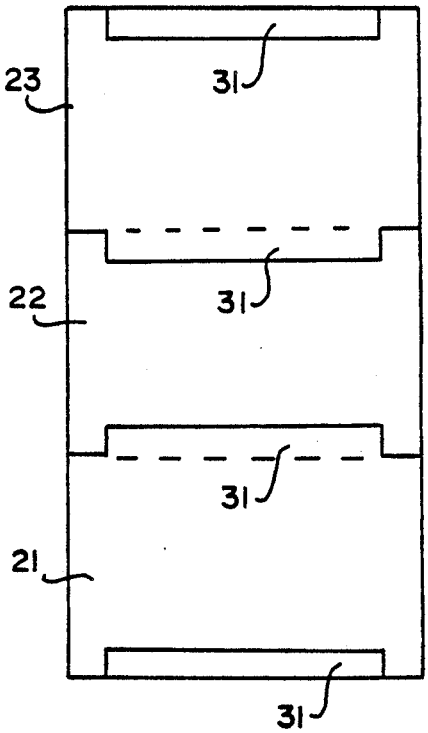
FIG. 2 is a floor plan of an assembled decontamination facility.

Typically, the three compartments 21–23 are joined or meshed as illustrated by the floor plan shown in FIG. 2.

However, alternate arrangements are often constructed. The passageways 31 through each of the compartments 21–23 are closed by two-piece flexible water shedding flaps or curtains 24, which are suspended from the transom 25, being secured thereto by tape, adhesive, or ties 26. Each flap 24 is also permanently secured to the passageway jambs 27 by adhesive or edge banding along the length of the vertical edge of jamb 27.

Each of the three compartments 21–23 is assembled at the site from a kit FIGS. 3–11 that includes, in addition to the passageway flaps 24, a rectangular tub-shaped water retaining base section 28, two water resistant foldable side wall panels 29 that insert within the base 28, and a rectangular cap 30 that inserts within the upright wall panels 29. The base 28 and the cap 30 mesh to form a shipping box, FIG. 3, for the folded wall panels 29, flaps 24, ties 26, and accessories. The transoms 25 are integral parts of the cap 30.

Figure 12:
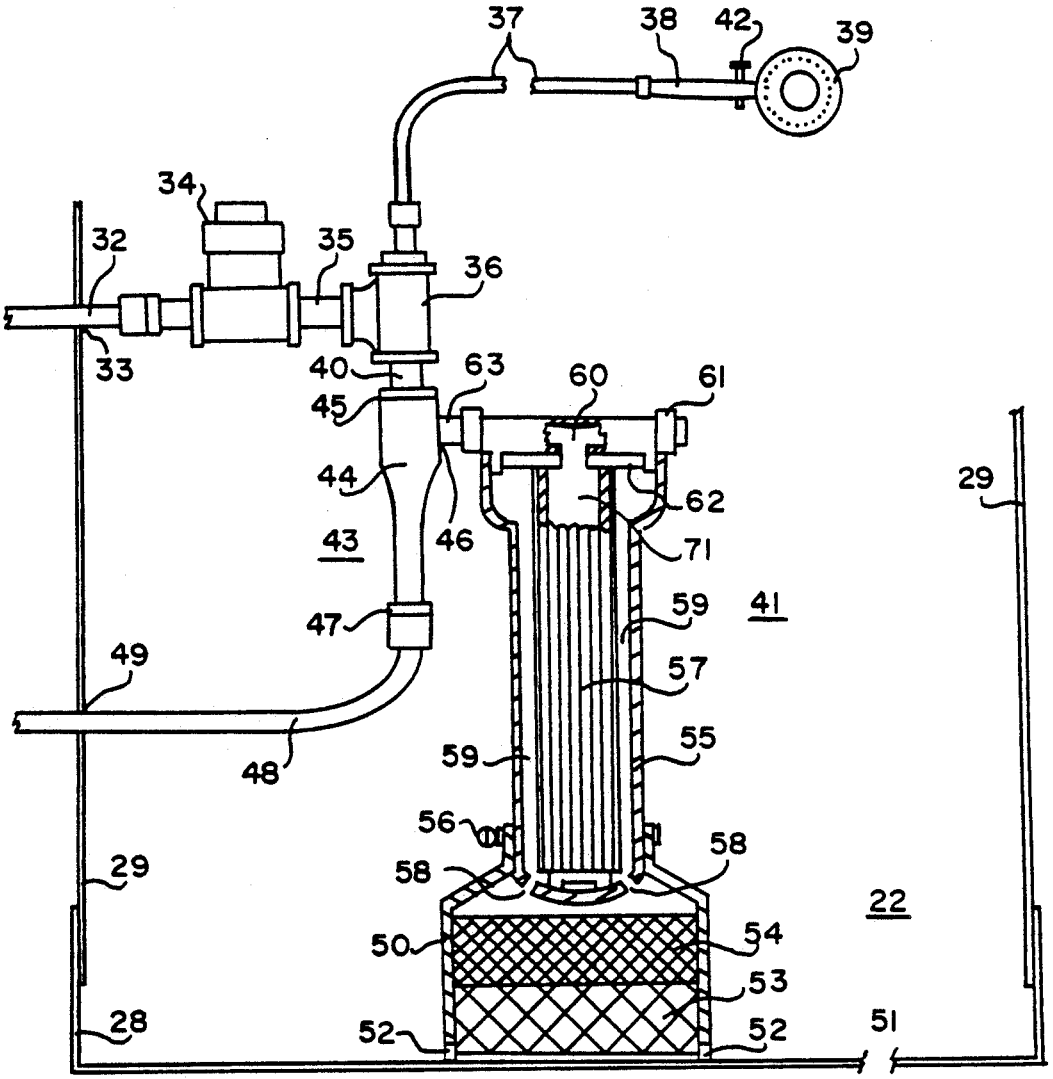
FIG. 12 is a partial cutaway illustration of the showers, effluent pump, multi-stage filtering and discharge subsystems.

The water supply and filtration subsystem for the modular shower is illustrated in FIG. 12. Clean water, at a suitable temperature, is obtained from an external source at a pressure of 40 psi typical (20 psi minimum) and at a flow rate of at least 6 gallons per minute through an input garden hose 32, that is inserted through a knockout opening 33 in a side wall panel 29 of the shower compartment 22. The input hose 32 is connected by a suitable fitting to an adjustable mechanical water timing valve 34 that has a range of adjustment, operable by the bather, of 0–120 minutes for automatic shut-off of the supply. The timer 34 output flows through a nipple 35 to a "Tee" coupler 36 which has dual water flow outputs; the first through suitable fittings to a flexible shower pipe or hose 37 that terminates in a shower wand 38 and shower head 39, and the second through a nipple 40 to the ejector drain pump and filtration subassembly 41. The shower wand 38 contains an on-off valve 42 for regulation of the shower.

The drain pump and filtration subassembly 41 is portable and is placed unattached upon the floor of the shower tub section 28. It includes an ejector pump 43 operating in response to the flow of pressurized water supplied through the input hose 32, timer 34, and "Tee" coupler 36. Filtration of the waste water of the showers is accomplished in the suction line of the ejector pump. In FIG. 12 the ejector venturi chamber 44 has pressure 45 and suction 46 input ports and a discharge port 47 to which a drain (garden) hose 48 is attached for conveying the filtered effluent or waste water through a second drain knockout opening 49 in the shower side wall panel 29 to a suitable external discharge point or sewer (not part of this invention).

On the suction side of the ejector pump 43 the open end of a semi-rigid tubular rubber base 50 rests upon the shower tub floor 51. Dispersed about the periphery of the rubber base 50 at its contact with the tub floor 51 are a multiplicity of waste water suction pickup openings 52 extending through the tubular wall. The interior cavity of the base 50 contains replaceable prefiltering for the waste water. Coarse prefilters 53 are overlayed with medium prefilters 54. Above the medium prefilters 54 the size of the rubber base 50 is reduced to fit upon a transparent filter case 55. The base 50 is secured to the filter case 55 by an adjustable metal band type of clamp 56.

The transparent filter case 55 contains a replaceable polishing filter 57, typically a 5 micron pleated filter element A multiplicity of input ports 58 are distributed in the bottom of the transparent filter case 55 so that the prefiltered waste water can be drawn into the input zone 59 of the filter case 55 surrounding the outer surfaces of the polishing filter 57. The suction of the ejector pump 43 draws the prefiltered waste water through the polishing filter 57 to an inner cavity 71, about the central axis of the filter case 55, then to an exit port 60 provided in a detachable top cap or housing 61 that is joined to the transparent filter case 55. A seal 62 is provided between the polishing filter 57 and the top cap 61 so that the waste water cannot bypass the polishing filter 57. The mating surfaces of the transparent filter case 55 and the detachable cap housing 61 are threaded for an air tight fit to enable suction action of the ejector pump 43 and for disassembly to replace expanded polishing filter elements 57. The exit port 60 within the cap housing 61 leads to an interconnecting nipple 63 with the venturi chamber 44. Periodic replacement of the filters 53–54 and 57, FIG. 12, which is normally a routine operation to recover the hazardous particles and contaminants of bathing, maintains the pumping efficiency of the combined pump and filtration subassembly.

Each kit for the on-site erection of the shower compartments 21–23, of FIGS. 1–2, contains a base or tub element 28, a cap or top element 30, two side wall panel elements 29, four passageway flaps or curtains 24, and a multiplicity of plastic ties 26. The base 28, the cap 30, and the wall panels 29 are fabricated of flat sheet semi rigid corrugated board materials which may be imprinted for purposes of folding and which may be worked with ordinary hand cutting tools. Typical materials may include plastics or paper products, or organic-plastic structural materials that are treated with a suitable water sealer and which may be selected for a period of shower usage and for biodegradability when the shower facility is discarded.

Figure 3:
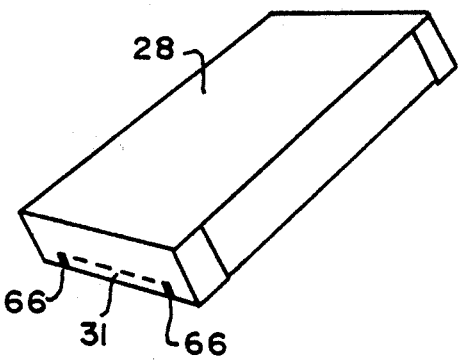
FIG. 3 is a perspective view of a compartment as prepared for shipment to a work site.
Figure 4:
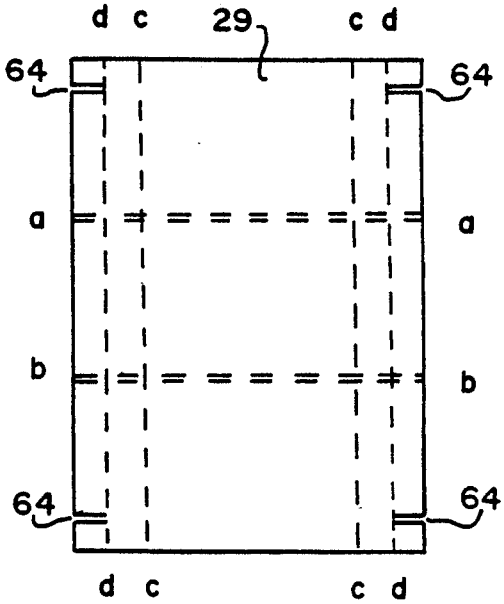
FIG. 4 is a pattern for the wall components of each compartment.

For the modular kit, packed for shipment, the outer receptacle shown in FIG. 3 is the base (or tub) section 28, which covers the meshing inner cap (or top) section 30 that contains folded side wall panels 29, passageway flaps 24, and assembly ties 26. To define the elements of the kit, FIG. 4 illustrates a preferred pattern for fabrication of side panels 29 from flat stock material Imprints are made along horizontal lines a—a and b—b (FIG. 4) for purposes of temporary folding the panel 29 in accordion-like fashion to dimensions that will fit within a fully fabricated cap 30 and base 28. For erection at a work site, the received panel 29 of the kit is unfolded to the pattern shown in FIG. 4. Imprints in the panel 29, along lines c—c and d—d allow vertical folding during the erection of the shower facility, the area between lines c—c and d—d forming the frontal passageway casings 27 and the area between lines d—d and the periphery of the panel 29 are foldable for inward or outward projection at the option of the assembler to effect a desired intermeshing of adjacent compartments. Slots 64 in the panel 29 permit interlocking within the base 28 and externally to cap 30 sections FIG. 10. In a typical application the unfolded panel 29 has dimensions of 41.5 and 78 inches in width and height, respectively.

Figure 5:
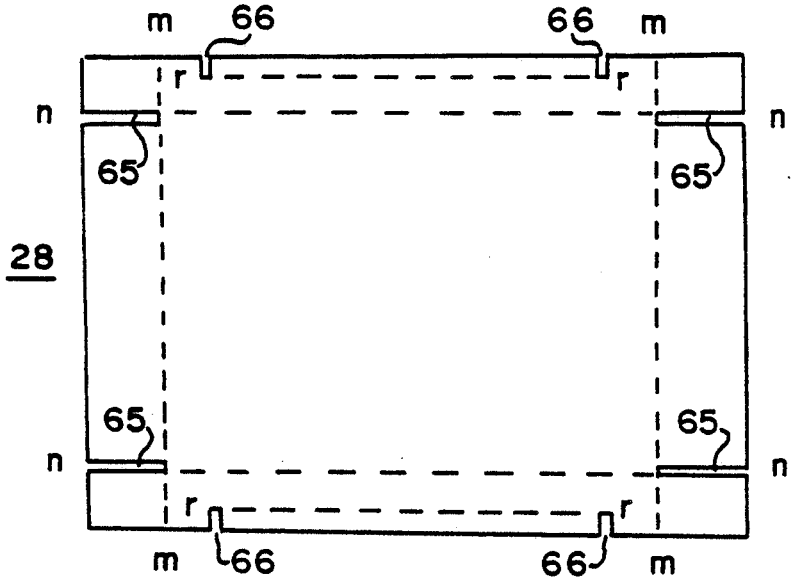
FIG. 5 is a pattern for the floor section of each compartment.

The pattern for the tub or base 28 section must provide compatible outside mating with the folded side panels 29. FIG. 5 illustrates a preferred pattern for the fabrication of the tub 28. For the cited typical application the blank sheet has dimensions of 42 by 58 inches in width and length, respectively. Imprints are provided along lines m—m and n—n to permit upward folding to establish raised sides for the tub or base section 28. Slots 65 enable the upward folding and permit an overlay wraparound at the corners of the tub or base 28 section that may be secured and made watertight by an adhesive binding such as hot melt glue, for example Slots 66, FIG. 5, allow folding of the cap section 30 along lines r—r for the formation of threshold ledges in the passageways 31 Upon assembly of the panels 29 with the base 28 the corner tabs of the panel 29, formed by slots 64, extend inside the base 28 beneath the threshold 31 formed by folding of the base 28 along lines r—r, FIG. 5. Assembly of panels 29 to the cap 30 is accomplished with the corner tabs of the panel 29, formed by slots 64, extending upon the outer surface of the cap 30 along the transom 25 formed by folding along lines z—z, FIGS. 6, 1 and 10.

Figure 6:
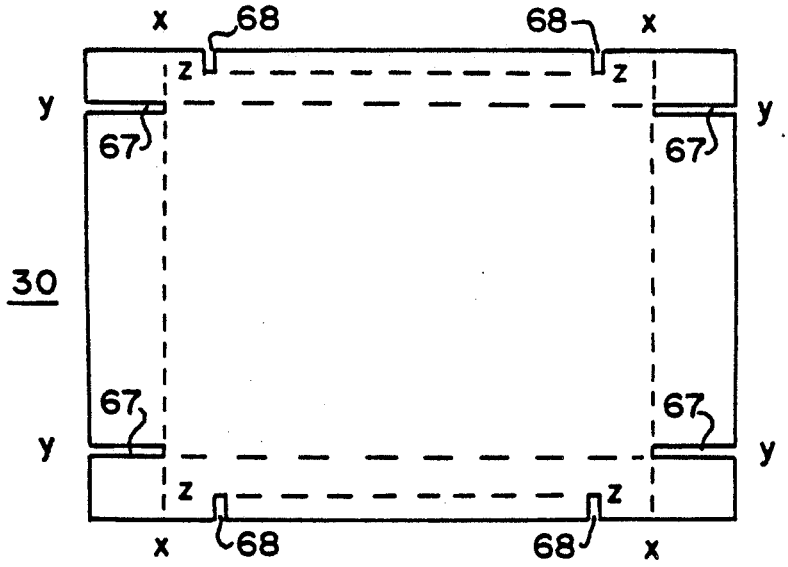
FIG. 6 is a pattern for the top section of each compartment.

The pattern for the cap 30 section provides compatible inside mating with the folded side panels 29. FIG. 6 illustrates a preferred pattern for the fabrication of the cap 30. For the cited typical application the blank sheet has dimensions of 41 by 57 inches. Imprints are provided along lines x—x and y—y to permit downward folding to establish dropped sides for the cap 30 section. Slots 67 enable the downward folding and permit an overlay wraparound at the corners of the cap section 30 that may be secured by an adhesive such as hot melt glue. Slots 68, FIG. 6 allow folding of the cap section 30 along lines z—z for the formation of the passageway transoms 25.

Figure 7:
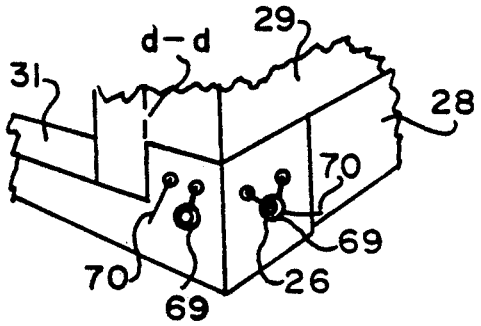
FIG. 7 details the plastic tie method of assembly of parts.
Figure 8:
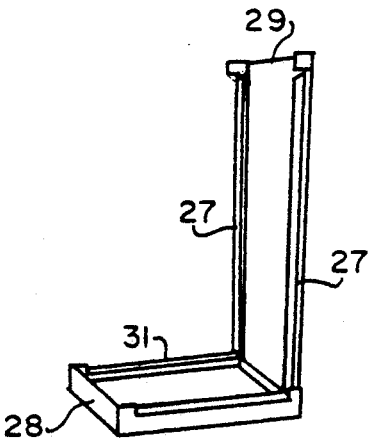
FIG. 8 illustrates the assembly of wall components to the bottom section.
Figure 9:
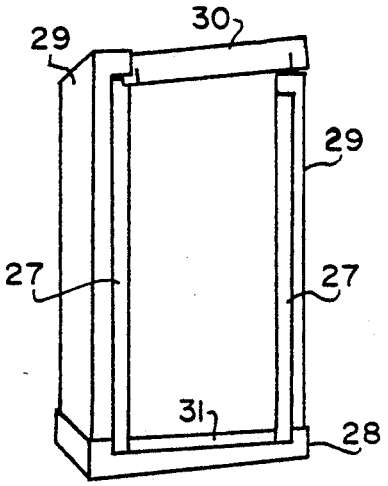
FIG. 9 illustrates the assembly of the top section to the wall components
Figure 10:
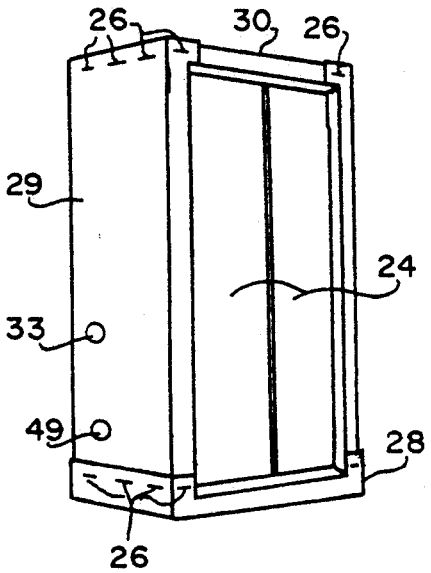
FIG. 10 illustrates the attachment of passageway curtains in each compartment.
Figure 11:
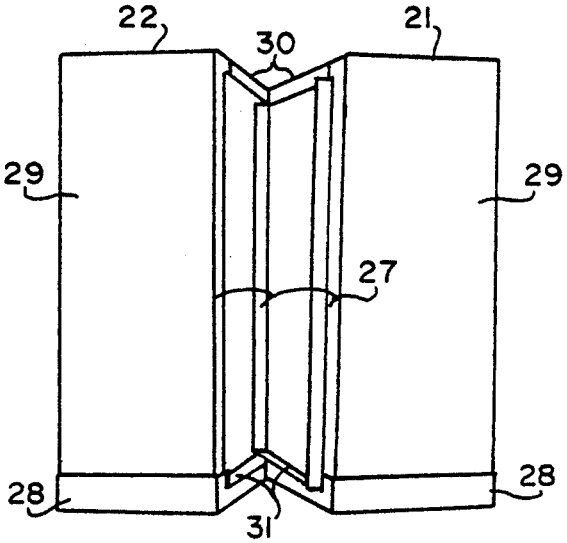
FIG. 11 illustrates interlocking of adjacent compartments.
Figure 13:
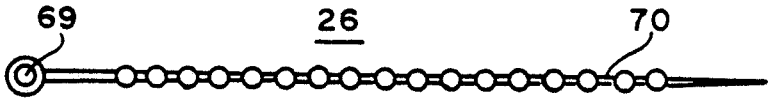
FIG. 13 illustrates a typical plastic tie.
Figure 12:
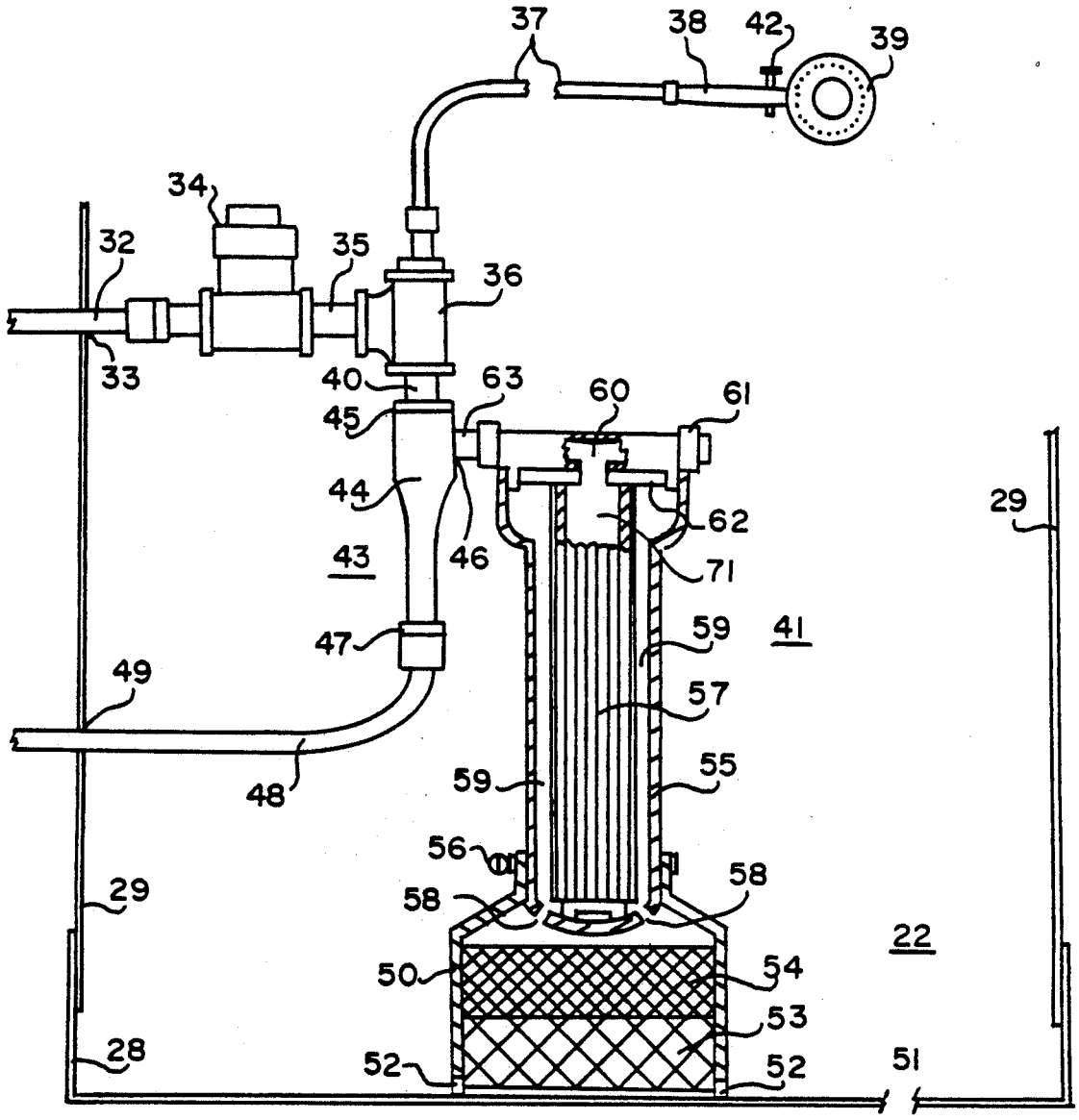
Figure 13:
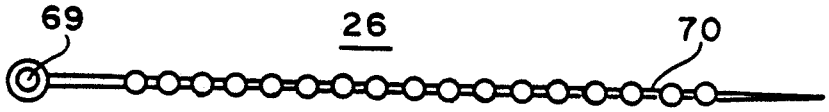

FIG. 7 illustrates the plastic tie method of assembling or joining side panels 29 to the tub 28 and cap 30 sections. The plastic tie FIG. 13 resembles an elongated flexible needle having an eye 69 at one end and a serrated stem 70 that is inserted and looped through a pair of matching holes in the abutting parts. During assembly the erecting workman may make pairs of matching holes as desired using an awl to pierce the abutting panels 29 and sections 28 and 30. The serrated stem 70 is fed through the eye 69 and is captive therein by the serrations to secure the assembly. Plastic ties 26 may be used in a disposable facility 20 together with adhesives to stabilize the assembly while the adhesive sets bonding the panels 29 to the cap 30, and tub 28 sections.

An embodiment of the modular bathing facility has been described. The modular units can be easily shipped, transported, erected, modified to suit site accessibility problems, used for a short period, and disposed of as waste. It should be understood that the number of contiguous compartments may be varied and that two or more bathing facilities may be erected and joined in a parallel configuration. With hand tools the units can be modified and joined in a right angle floor pattern. Also, with hand tools, the modular compartments 21, 22, or 23 can be shortened in height by removal of an equal portion of each panel 29, adjacent to one end, and by making new assembly slots 64. Variations in size and in materials may be made without departing from the invention. Accordingly, it is intended that the scope of the invention be limited only by the claims which follow.

I claim:

1. A modular bathing facility in portable kit form for site erection and for personal use during a temporary period of on-site activities, comprising:

(a) at least one personal privacy compartment of disposable water resistant materials, comprising:
  (1) a shallow water holding tub that also serves as a floor for said compartment;
  (2) first and second wall panels for attachment to opposing sides of said tub;
  (3) a cap for bridging the tops of said wall panels; and
  (4) a means for entry and exit from said privacy compartment; and (b) a manually activated plumbing subsystem comprising:
  (1) a first flexible hose for connection of said bathing facility to an external supply of pressurized water;
  (2) a timer valve for connection to the output of said first hose responsive to manual adjustment by an attending bather for controlling the flow and automatic shut-off of said pressurized water supply;
  (3) a "Tee" coupler having a receiving port communicating with the output of said timer valve, and first and second exit ports;
  (4) a shower bathing subassembly comprising a shower head, a manually operable valve for regulation of said shower, and a flexible hose and wand linking said first exit port of said "Tee" coupler to said shower valve;
  (5) a waste water filter and evacuation pump subassembly connected to the second exit port of said "Tee" coupler, operative by the flow of said pressurized water in response to manual adjustment of said timer valve, said pump and filter subassembly adapted for communicating with said tub floor for filtering and evacuation of substantially all of the waste fluids of bathing, for recovery of hazardous particles and contaminants of bathing, and for discharge of filtered residual water, said subassembly comprising:
    an evacuation pump comprising a three port venturi chamber;

means for connecting the input pressure port of said venturi chamber to said second exit port of said "Tee" coupler;

means for connecting the suction port of said venturi chamber to said waste water filter;

means for connecting the discharge port of said venturi chamber to an external drainage disposal site;

a waste water filter, responsive to the action of said pump, comprising:

a semi-rigid thin wall tubular base comprising a first end opening adapted for contact with said tub floor with the surface perimeter of said first end opening comprising a multiplicity of substantially uniformly distributed openings for suction pickup of waste water, said tubular base extending upward to form a cavity therein before terminating in a second end opening:

a first replaceable prefilter for coarse particles for placement in multiple layers completely filling a first portion of said tubular base cavity adjacent to and in contact with said tub floor;

a second replaceable prefilter for medium size particles for placement in multiple layers completely filling a second portion of said tubular base cavity superimposed upon said first prefilter for coarse particles;

a transparent cartridge type filter case comprising an internal cavity; a top opening into said internal cavity; a multiplicity of inlet ports distributed in substantial uniformity in the bottom of said filter case for directing prefiltered waste fluids to the input zone of said filter cavity, said filter case and inlet ports adapted for secured assembly within said second end opening of said tubular base;

a replaceable polishing filter for insertion through said top opening of said transparent filter case;

a detachable cap for enclosing said top opening of said transparent filter case;

an exit passageway for filtered waste water within said detachable cap;

means for sealing said detachable cap, said filter case and said polishing filter to force said waste fluids through said polishing filter; and means for connecting said cap exit passageway to said suction port of said evacuation pump.

2. A modular bathing facility in portable kit form for site erection and for personal use during a temporary period of on-site activities, comprising:

(a) a multiplicity of modular privacy compartments for contiguous erection having an entry way and interconnecting passageways therebetween to an exit, said multiplicity of modular compartments comprising:

(1) at least one interior compartment for personal bathing;

(2) at least one compartment contiguous with said bathing compartment for dirty personal derobing before bathing;

(3) at least one compartment contiguous with said bathing compartment for clean personal dressing following bathing; and (4) a means for interlocking said multiplicity of modular compartments with alignment of said interconnecting passageways;

(b) said modular privacy compartments of similar disposable water resistant materials, each said compartment further comprising:

(1) a shallow water holding tub that also serves as a floor for said compartment;

(2) first and second wall panels for attachment to opposing sides of said tub;

(3) a cap for bridging the tops of said wall panels; and (4) a means for entry and exit from said privacy compartment;

(c) a manually activated plumbing subsystem comprising:

(1) means for connecting said bathing compartment to an external supply of pressurized water;

(2) means for connecting said bathing compartment to an external drainage disposal site;

(3) means for manual initiation of a flow of said pressurized water;

(4) means for personal shower bathing; and (5) a subassembly comprising a filter and an evacuation pump, the combination thereof being operative upon said flow of pressurized water for recovery of hazardous particles and contaminants of bathing from substantially all of the waste effluent of bathing and for discharge of filtered water to said external disposal site, said subassembly further comprising:

a venturi chamber, operative upon said flow of pressurized water, for pumping said waste effluents of bathing from said water holding tub;

a first replaceable prefilter for recovery of the coarse particles of said waste effluent for receiving said waste effluents from the floor of said water holding tub;

a second replaceable prefilter for recovery of medium size particles of said waste effluent for receiving said waste effluents in succession from said first prefilter of coarse particles;

a third replaceable polishing filter for recovery of smaller size particles of said waste effluent for receiving said waste effluents in further succession from said second prefilter of medium particles, and for delivery of filtered waste water to a suction port of said venturi chamber; and means for sealed containment of said venturi chamber, said first, second, and third filters in a housing structure comprising: an input port for receiving said flow of pressurized water into said venturi chamber, at least one suction port communicating with said floor of the water holding tub for delivery of said waste effluent to said first coarse prefilter, and an exit port for discharge of said filtered water to said means of connection to an external drainage disposal site.

3. A disposable modular bathing facility in portable kit form for site erection and personal decontamination bathing during a temporary period of activity, comprising:

(a) a multiplicity of modular privacy booths for contiguous erection providing an entry way and interconnecting passageways therebetween to an exit, said multiplicity of modular booths comprising:

(1) a first compartment for dirty personal derobing before bathing;

(2) a second interior shower compartment for personal bathing contiguous with said first compartment and comprising a shallow water resistant tub for the collection of waste water effluents of bathing, said tub serving as a floor and foundation for said interior shower compartment;

(3) a third compartment for clean personal dressing following bathing, said third compartment contiguous with said interior shower compartment; and (4) means for interlocking said multiplicity of modular compartments with alignment of said interconnecting passageways;

(b) a manually controlled plumbing subsystem, operable upon a flow of a pressurized supply of water, for said shower compartment, comprising:

(1) a first flexible hose for supply of pressurized water from an external source to said shower compartment;

(2) a timer valve, adapted for receiving the output of said first hose, said timer valve adjustable by an attending bather for automatic shut-off of said flow of pressurized water;

(3) a "Tee" coupler communicating with said timer valve for directing said flow of pressurized water to first and second exit ports;

(4) a shower subassembly comprising a flexible wand connected to said first exit port of said "Tee" coupler; a manually operable valve for controlling the flow of water from said flexible wand; and a shower head attached to said wand for personal bathing responsive to a bather's operation of said manual valve;

(5) a second flexible hose for drainage to an external discharge point;

(6) a portable pump and filter subassembly for placement upon said tub floor of said shower compartment comprising:

an input pressure port for connection to said second exit port of said "Tee" coupler;

an exit port for connection to said second flexible hose for force drainage to said external discharge point; and means, responsive to said flow of pressurized water, for the evacuation of substantially all of the waste effluents of shower bathing from said shallow tub, for the recovery of particulate materials from said waste effluents, and for the delivery of filtered water to said second hose and said external discharge point;

(7) said portable pump and filter subassembly further comprising:

a venturi chamber communicating with said second exit port of said "Tee" coupler for a flow of said supply of pressurized water, with said second flexible hose for forced drainage to said external discharge point, and with said filter for said evacuation by suction forces of said waste effluents of bathing from said shallow tub;

a semi-rigid thin wall tubular base comprising a first open end adapted for contact with said tub floor, the periphery of said first end having a multiplicity of uniformly distributed suction openings for communicating with said tub floor for evacuating waste effluents therefrom, said tubular base extending upward to form a prefilter cavity therein before terminating in a second open end;

a first replaceable prefilter for coarse particles completely filling a first portion of said tubular base cavity adjacent to and in contact with said tub floor;

a second replaceable prefilter for medium size particles completely filling a second portion of said tubular base cavity superimposed upon said first prefilter;

a transparent cartridge type filter case adapted for secured assembly within said second open end of said tubular base, said filter case comprising an internal cavity, a top opening into said cavity, a multiplicity of inlet ports distributed in substantial uniformity in the bottom of said transparent case for communicating with said prefilter cavity of said tubular base; and for directing prefiltered waste fluids to an input receiving zone of said transparent case;

replaceable polishing filter for insertion through said top opening of said transparent case;

a detachable cap for enclosing said open top of said transparent filter case;

an exit port for filtered waste water within said detachable cap, said passageway communicating with the output of said polishing filter;

means for sealing said detachable cap, said filter case, and said polishing filter to draw said waste fluids through said filters in response to suction forces of said venturi chamber; and means for connecting said cap exit passageway to said suction port of said venturi chamber.

* * * * *